US007551150B2

(12) United States Patent
Moon

(10) Patent No.: US 7,551,150 B2
(45) Date of Patent: Jun. 23, 2009

(54) APPARATUS AND METHOD FOR DRIVING PLASMA DISPLAY PANEL

(75) Inventor: Seong Hak Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 559 days.

(21) Appl. No.: 11/070,005

(22) Filed: Mar. 3, 2005

(65) Prior Publication Data

US 2005/0195135 A1 Sep. 8, 2005

(30) Foreign Application Priority Data

Mar. 5, 2004 (KR) ..... 10-2004-0015057

(51) Int. Cl.
*G09G 3/28* (2006.01)

(52) U.S. Cl. ..... 345/67; 345/60

(58) Field of Classification Search ..... 345/60, 345/41, 37

See application file for complete search history.

(56) References Cited

U.S. PATENT DOCUMENTS

| | | | | |
|---|---|---|---|---|
| 4,866,349 | A * | 9/1989 | Weber et al. | 315/169.4 |
| 6,373,451 | B1 * | 4/2002 | Kang et al. | 345/60 |
| 6,472,826 | B2 * | 10/2002 | Kang et al. | 315/169.4 |
| 6,483,249 | B2 * | 11/2002 | Ito et al. | 315/169.3 |
| 6,496,166 | B1 * | 12/2002 | Onozawa et al. | 345/60 |
| 6,559,815 | B1 * | 5/2003 | Kang et al. | 345/60 |
| 6,587,085 | B2 * | 7/2003 | Lee et al. | 345/60 |
| 6,603,449 | B1 * | 8/2003 | Kang et al. | 345/67 |
| 6,693,607 | B1 * | 2/2004 | Lee et al. | 345/60 |
| 6,867,552 | B2 * | 3/2005 | Takamori et al. | 315/169.4 |
| 6,906,690 | B2 * | 6/2005 | Lim | 345/60 |
| 7,242,399 | B2 * | 7/2007 | Onozawa et al. | 345/212 |
| 2002/0044106 | A1 | 4/2002 | Iseki | 345/60 |
| 2002/0186184 | A1 * | 12/2002 | Lim | 345/60 |
| 2003/0234750 | A1 * | 12/2003 | Seo et al. | 345/30 |
| 2004/0070350 | A1 * | 4/2004 | Kwak et al. | 315/169.3 |
| 2004/0135746 | A1 * | 7/2004 | Lee et al. | 345/60 |
| 2005/0073485 | A1 * | 4/2005 | Kim et al. | 345/63 |
| 2005/0162346 | A1 * | 7/2005 | Han et al. | 345/60 |
| 2005/0195134 | A1 * | 9/2005 | Moon | 345/67 |
| 2006/0187148 | A1 * | 8/2006 | Kwak et al. | 345/67 |
| 2008/0143643 | A1 * | 6/2008 | Moon | 345/60 |

FOREIGN PATENT DOCUMENTS

| | | |
|---|---|---|
| EP | 1 065 650 A2 | 1/2001 |
| EP | 1 598 798 A2 | 11/2005 |
| EP | 1 622 118 A2 | 2/2006 |
| EP | 1 657 700 A1 | 5/2006 |

OTHER PUBLICATIONS

European Search Report dated Nov. 17, 2006.

* cited by examiner

*Primary Examiner*—Bipin Shalwala
*Assistant Examiner*—Afroza Y Chowdhury
(74) *Attorney, Agent, or Firm*—Ked & Associates, LLP

(57) ABSTRACT

Disclosed herein is an apparatus and method for driving a plasma display panel, wherein electromagnetic interference is minimized and stability is improved. According to the present invention, the apparatus for driving a PDP includes a plurality of scan electrodes and sustain electrodes, which are formed parallel to each other, and a scan driving unit for alternately supplying sustain pulses of the positive polarity and the negative polarity to the scan electrodes during a sustain period, wherein the sustain electrodes are connected to a ground voltage source, and thus always keep a ground voltage.

20 Claims, 6 Drawing Sheets

APPARATUS AND METHOD FOR DRIVING PLASMA DISPLAY PANEL

CROSS-REFERENCES TO RELATED APPLICATIONS

This non-provisional application claims priority under 35 U.S.C. § 119(a) on patent application Ser. No. 10-2004-0015057 filed in Korea on Mar. 5, 2004, the entire contents of which are hereby incorporated by reference.

BACKGROUND OF THE INVENTION

1. Field of the Invention

The present invention relates to an apparatus and method for driving a plasma display panel, and more particularly, to an apparatus and method for driving a plasma display panel, wherein electromagnetic interference is minimized and stability is improved.

2. Background of the Related Art

A plasma display panel (hereinafter, referred to as a 'PDP') is adapted to display an image including characters or graphics by light-emitting phosphors with ultraviolet of 147 nm generated during the discharge of a gas such as He+Xe, Ne+Xe or He+Ne+Xe. This PDP can be easily made thin and large, and it can provide greatly increased image quality with the recent development of the relevant technology. Particularly, a three-electrode AC surface discharge type PDP has advantages of lower driving voltage and longer product lifespan as a voltage necessary for discharging is lowered by wall charges accumulated on a surface upon discharging and electrodes are protected from sputtering caused by discharging.

FIG.1 is a perspective view illustrating the structure of a discharge cell of a conventional three-electrode AC surface discharge type PDP.

Referring now to FIG. 1, a discharge cell of a three-electrode AC surface discharge type PDP includes a scan electrodes Y and a sustain electrode Z which are formed on the bottom surface of an upper substrate 10, and an address electrode X formed on a lower substrate 18. The scan electrodes Y includes a transparent electrode 12Y, and a metal bus electrode 13Y which has a line width smaller than that of the transparent electrode 12Y and is disposed at one side edge of the transparent electrode. Further, the sustain electrode Z includes a transparent electrode 12Z, and a metal bus electrode l3Z which has a line width smaller than that of the transparent electrode l2Z and is disposed at one side edge of the transparent electrode.

The transparent electrodes 12Y and 12Z, which are generally made of ITO (indium tin oxide), are formed on the bottom surface of the upper substrate 10. The metal bus electrodes 13Y and 13Z are generally formed on the transparent electrodes 12Y and 12Z made of metal such as chromium (Cr), and serves to reduce a voltage drop caused by the transparent electrodes 12Y and 12Z having high resistance. On the bottom surface of the upper substrate 10 in which the scan electrodes Y and the sustain electrode Z are placed parallel to each other is laminated an upper dielectric layer 14 and a protective layer 16. The upper dielectric layer 14 is accumulated with a wall charge generated during plasma discharging. The protective layer 16 is adapted to prevent damages of the upper dielectric layer 14 due to sputtering caused during plasma discharging, and improve efficiency of secondary electron emission. As the protective layer 16, magnesium oxide (MgO) is generally used.

A lower dielectric layer 22 and barrier ribs 24 are formed on the lower substrate 18 in which the address electrode X is formed. A phosphor layer 26 is applied to the surfaces of both the lower dielectric layer 22 and the barrier ribs 24. The address electrode X is formed on the lower substrate 18 in the direction in which the scan electrodes Y and the sustain electrode Z intersect with each other. The barrier ribs 24 are in the form of stripe or lattice to prevent leakage of an ultraviolet and a visible light generated by discharging to an adjacent discharge cell. The phosphor layer 26 is excited with an ultraviolet generated during the plasma discharging to generate any one visible light of red, green and blue lights. An inert mixed gas is injected into the discharge spaces defined between the upper substrate 10 and the barrier ribs 24 and between the lower substrate 18 and the barrier ribs 24.

This PDP is driven with one frame being time-divided into a plurality of sub-fields having a different number of emission in order to implement the gray scale of an image. Each of the sub fields is divided into an initialization period for initializing the entire screen, an address period for selecting a scan line and selecting a cell from the selected scan line, and a sustain period for implementing gray scales according to the number of discharging.

In this time, the initialization period is divided into a set-up period where a ramp-up waveform is applied, and a set-down period where a ramp-down waveform is applied. If it is desired to display an image with 256 gray scales, a frame period (16.67 ms) corresponding to 1/60seconds is divided into eight sub-fields SF1 to SF8, as shown in FIG. 2. Each of the sub-fields SF1 to SF8 is subdivided into the initialization period, the address period and the sustain period, as described above. The initialization period and the address period of each of the sub-fields SF1 to SF8 are the same every sub-field, whereas the sustain period increases in the ratio of $2^n$ (where, n=0,1,2,3,4,5,6,7) in each sub-field.

FIG. 3 is a block diagram of an apparatus for driving a PDP in the prior art.

Referring to FIG. 3, the conventional apparatus for driving the PDP includes an address driving unit 32 for driving address electrodes X1 to Xm disposed in a panel 30, a scan driving unit 34 for driving scan electrodes Y1 to Yn disposed in the panel 30, a sustain driving unit 36 for driving sustain electrodes Z1 to Zn disposed in the panel 30, a driving voltage generator 40 for supplying driving voltages to the driving units 32, 34 and 36, and a timing controller 38 for supplying control signals SCS1 to SCS3 to the driving units 32, 34 and 36.

The driving voltage generator 40 generates a variety of driving voltages so that a driving waveform as shown in FIG. 4 can be generated, and supplies the generated voltages to the address driving unit 32, the scan driving unit 34 and the sustain driving unit 36. For example, the driving voltage generator 40 generates voltages, such as Vsetup, −Vw, Vr and Vs, and supplies the voltages to the scan driving unit 34. It generates a voltage Vs, and provides the voltage to the sustain driving unit 36. Furthermore, the driving voltage generator 40 generates a voltage Va, and provides it to the address driving unit 32.

The timing controller 38 generates a variety of the switching control signals so that the driving waveform as shown in FIG. 4 can be generated, and supplies the generated switching control signals to the address driving unit 32, the scan driving unit 34 and the sustain driving unit 36. For example, the timing controller 38 generates a first switching control signal SCS1 and a second switching control signal SCS2, and supplies the signals to the scan driving unit 34 and the sustain driving unit 36, respectively. Also, the timing controller 38 generates a third switching control signal SCS3 and a data clock DCLK, and supplies them to the address driving unit 32.

The address driving unit 32 serves to supply image data, which are received from the outside, to the address electrodes X1 to Xm, under the control of the data clock DCLK and the third switching control signal SCS3, both of which are supplied from the timing controller 38.

The scan driving unit 34 supplies a reset pulse, a scan pulse scan and a sustain pulse sus to the scan electrodes Y1 to Ym, under the control of the first switching control signal SCS1 outputted from the timing controller 38.

The sustain driving unit 36 supplies a positive polarity voltage (Vs), the sustain pulse sus and an erase pulse erase to the sustain electrodes Z1 to Zn, under the control of the second switching control signal SCS2 outputted from the timing controller 38.

The driving waveform applied to the electrodes will now be described in detail with reference to FIG. 4. In a set-up period of the initialization period, a ramp-up waveform Ramp-up is applied to all the scan electrodes Y at the same time. A weak discharge is generated within cells of the entire screen by the ramp-up waveform Ramp-up, thus generating wall charges within the cells. In the set-down period, after the ramp-up waveform Ramp-up is applied, a ramp-down waveform Ramp-down, which falls from a voltage of the positive polarity that is lower than the peak voltage of the ramp-up waveform Ramp-up, is applied to the scan electrodes Y at the same time. The ramp-down waveform Ramp-down generates a weak erase discharge within the cells to erase the wall charges generated by a set-up discharge and unnecessary charges among space charges and also to allow the wall charges necessary for an address discharge to uniformly remain within the cells of the entire screen.

In the address period, simultaneous when the scan pulse scan of the negative polarity is sequentially applied to the scan electrodes Y, the data pulse data of the positive polarity is applied to the address electrodes X. As a voltage difference between the scan pulse scan and the data pulse data and the wall voltage generated in the initialization period are added, the address discharge is generated within cells to which the data pulse data is applied. The wall charges are generated within cells selected by the address discharge.

Meanwhile, during the set-down period and the address period, a positive DC voltage of the sustain voltage level (Vs) is applied to the sustain electrodes Z.

In the sustain period, the sustain pulse sus is alternately applied to the scan electrodes Y and the sustain electrodes Z. Then, in cells selected by the address discharge, a sustain discharge is generated in the form of a surface discharge between the scan electrodes Y and the sustain electrodes Z whenever every sustain pulse sus is applied as wall voltages within the cells and the sustain pulse sus are added. After the sustain discharge is completed, an erase ramp waveform erase having a small pulse width is applied to the sustain electrodes Z to erase the wall charges within the cells.

In such a conventional PDP, during the sustain period, the scan electrodes Y and the sustain electrodes Z are alternately applied with the sustain pulse sus. At this time, when the sustain pulse sus is supplied to the scan electrodes Y, the sustain electrodes Z is supplied with the ground voltage GND. When the sustain pulse sus is provided to the sustain electrodes Y, the scan electrodes Z is supplied with the ground voltage GND. That is, since a high current flows when the sustain pulse sus is provided to a given electrodes Y or Z, the remaining electrode to which the sustain pulse sus is not supplied is connected to the ground voltage GND, so that the operation is stabilized. However, during the sustain period, in order for the scan electrodes Y and the sustain electrodes Z to be connected to the sustain pulse sus and the ground voltage GND in an alternate way, switching means included in the scan driving unit 34 and the sustain driving unit 36 perform lots of switching operations. Accordingly, there is a problem in that high EMI is generated. Furthermore, in the prior art, since lots of switching means (i.e., line is long) are needed in order for the scan electrodes Y and the sustain electrodes Z to be connected to the ground voltage GND, there is a problem in that additional noise is generated.

Generally, in order to stabilize the operation of a PDP, any one of the scan electrodes Y and the sustain electrodes Z has to be connected to the ground voltage GND so that a voltage level can be stabilized. Practically, however, if any one of the scan electrodes Y and the sustain electrodes Z is connected to the ground voltage GND, introduction of external noise, generation of EMI, etc. can be minimized. In the prior art, however, since a variety of driving waveforms are supplied to the scan electrodes Y and the sustain electrodes Z, it is difficult to secure the stability of a PDP.

Moreover, in the prior art, the scan driving unit 34 and the sustain driving unit 36 include switching means which are connected to the scan electrodes Y and the sustain electrodes Z, respectively, in a push-pull type. If the switching means are connected in the push-pull type as such, lots of the switching means are needed. As a result, there are problems in that the manufacture cost is increased, leakage current is generated, etc.

SUMMARY OF THE INVENTION

Accordingly, the present invention has been made in view of the above problems occurring in the prior art, and it is an object of the present invention to provide an apparatus and method for driving a plasma display panel, wherein electromagnetic interference can be minimized and stability can be also improved.

To achieve the above object, according to the present invention, there is provided an apparatus for driving a PDP, including a plurality of scan electrodes and sustain electrodes, which are formed parallel to each other, and a scan driving unit for alternately supplying sustain pulses of the positive polarity and the negative polarity to the scan electrodes during a sustain period, wherein the sustain electrodes are connected to a ground voltage source, and thus always keep a ground voltage.

The scan driving unit includes a first switching means disposed between a sustain voltage source of the positive polarity and the scan electrodes, a second switching means disposed between a sustain voltage source of the negative polarity and the scan electrodes, a third switching means disposed between the ground voltage source and the scan electrodes, and fourth switching means and diodes, which are connected between a common terminal of the first to third switching means and the scan electrodes, respectively, in a parallel manner.

If the first switching means is turned on, the voltage of the positive polarity of the sustain voltage source is applied to the scan electrodes as the sustain pulse of the positive polarity through the first switching means and the diodes.

If the second switching means and the fourth switching means are turned on, the sustain pulse of the negative polarity is applied to the scan electrodes.

After the sustain pulse of the positive polarity is applied, the third switching means and the fourth switching means are turned on, and after the sustain pulse of the negative polarity is applied, the third switching means are turned on. Thus, the voltage of the ground voltage source is applied to the scan electrodes.

The scan driving unit includes a first switching means disposed between a sustain voltage source of the positive polarity and the scan electrodes, a second switching means disposed between a sustain voltage source of the negative polarity and the scan electrodes, a third switching means disposed between the ground voltage source and the scan electrodes, fourth switching means respectively disposed between the second switching means and the scan electrodes, and fifth switching means and diodes, which are connected between a common terminal of the first and third switching means and the scan electrodes, respectively, in a parallel manner.

If the first switching means is turned on, the voltage of the positive polarity of the sustain voltage source is applied to the scan electrodes as the sustain pulse of the positive polarity through the first switching means and the diodes.

If the second switching means and the fourth switching means are turned on, the sustain pulse of the negative polarity is applied to the scan electrodes.

After the sustain pulse of the positive polarity is applied, the third switching means and the fifth switching means are turned on, and after the sustain pulse of the negative polarity is applied, the third switching means are turned on. Thus, the voltage of the ground voltage source is applied to the scan electrodes.

According to the present invention, there is provided a method of driving a PDP, including the steps of alternately supplying sustain pulses of the positive polarity and the negative polarity to scan electrodes during a sustain period of sub-fields, and supplying a ground voltage to sustain electrodes, which are formed parallel to scan electrodes, during a sub-field period.

In the present invention, since sustain electrodes always keep a ground voltage, introduction of external noise, generation of EMI, etc. can be minimized. Furthermore, in the present invention, sustain electrodes are always kept to a ground voltage, i.e., the flow path of current shortens. Due to this, generation of additional noise can be prevented, and the stability of a PDP can be thus secured.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

Preferred embodiments of the present invention will be described in more detail with reference to the drawings.

Figure 1:
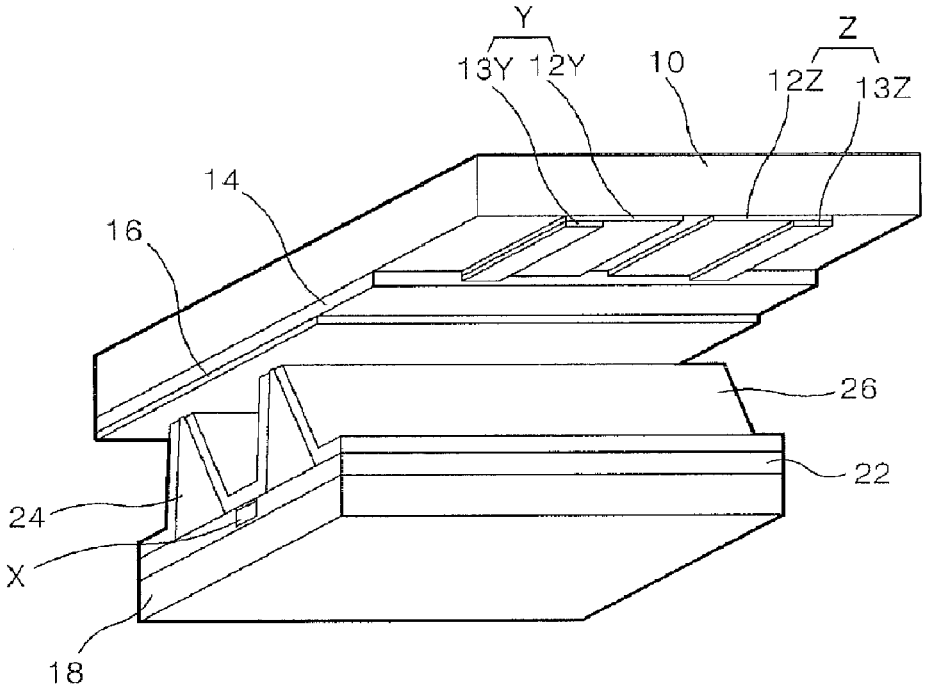
Fig. 1 (Prior Art)
FIG. 1 is a perspective view illustrating the structure of a discharge cell of a conventional three-electrode AC surface discharge type PDP.
Figure 2:
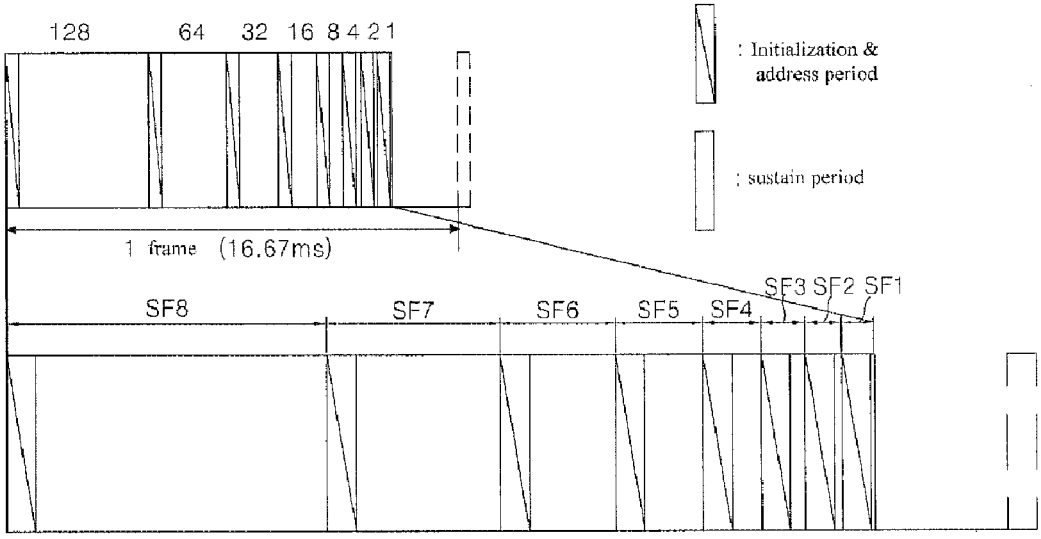
Fig. 2 (Prior Art)
FIG. 2 shows one frame of a PDP.
Figure 3:
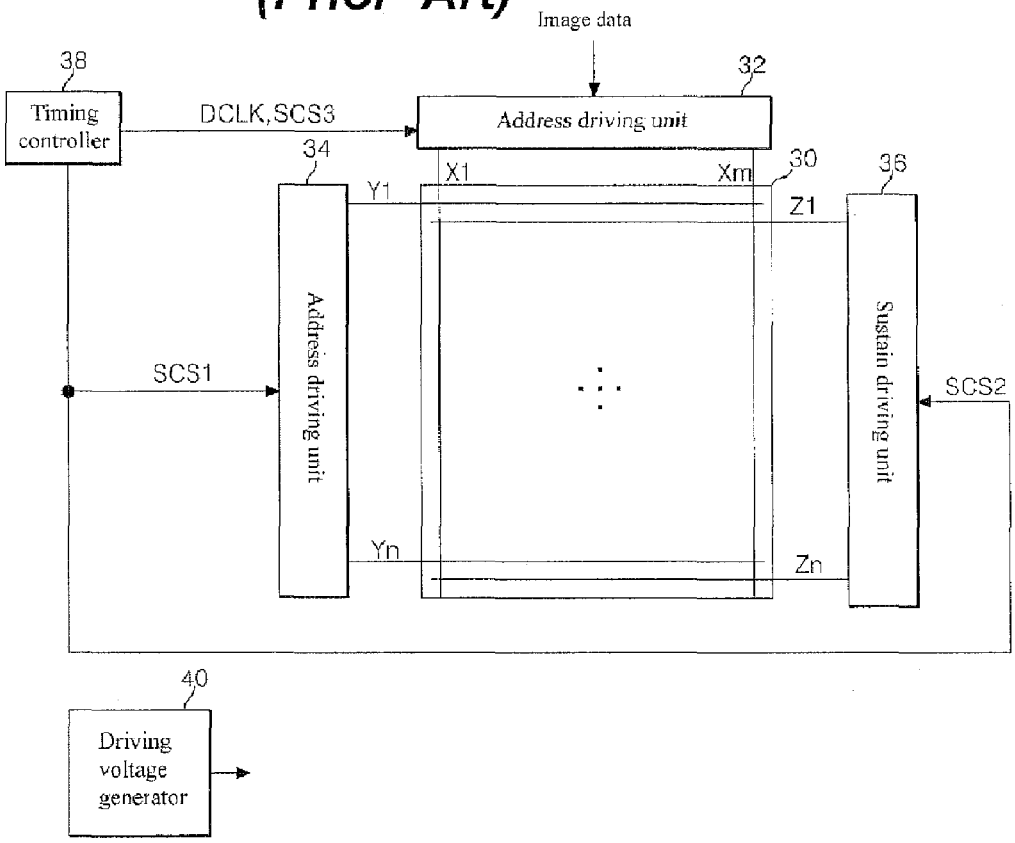
Fig. 3 (Prior Art)
FIG. 3 is a block diagram of an apparatus for driving a conventional PDP.
Figure 4:
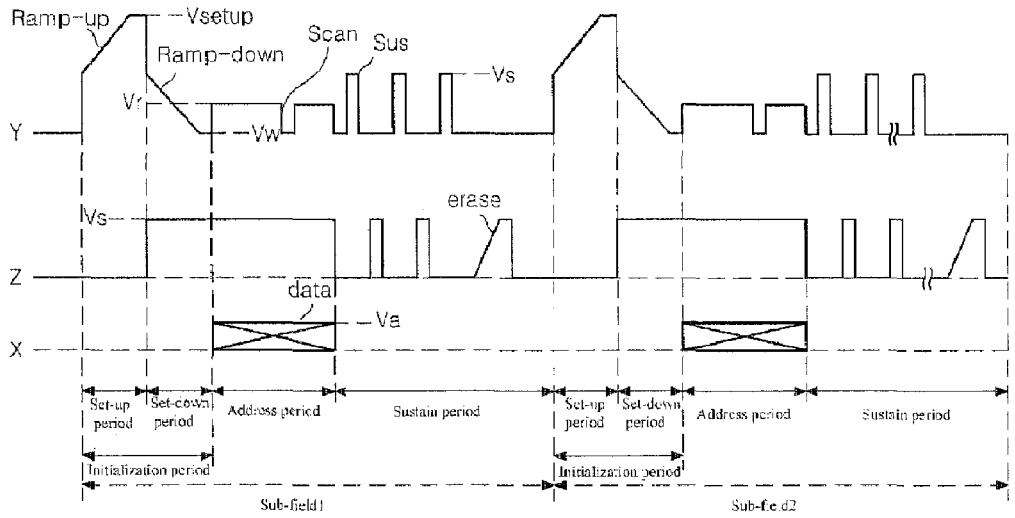
Fig. 4 (Prior Art)
FIG. 4 is a waveform showing a method of driving a conventional PDP.
Figure 5:
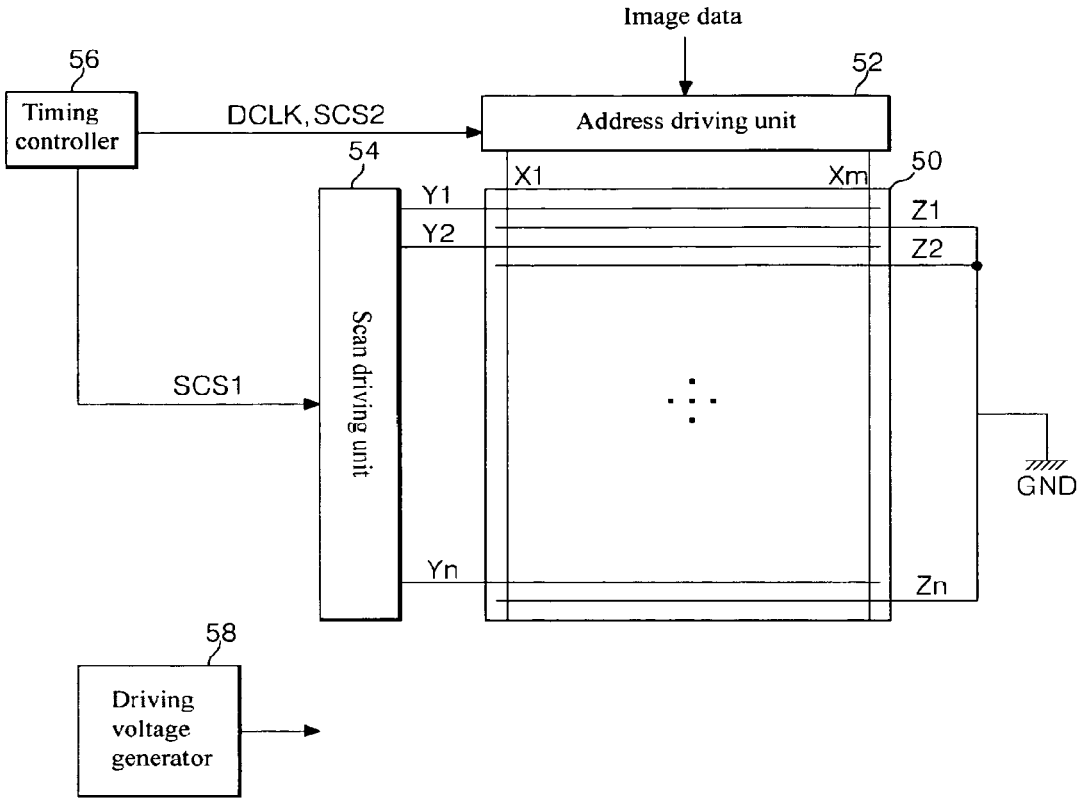
FIG. 5 is a block diagram showing an apparatus for driving a PDP according to an embodiment of the present invention.

FIG. 5 is a block diagram showing an apparatus for driving a PDP according to an embodiment of the present invention.

Referring to FIG. 5, the apparatus for driving the PDP according to an embodiment of the present invention includes an address driving unit 52 for driving address electrodes X1 to Xm disposed in a panel 50, a scan driving unit 54 for driving scan electrodes Y1 to Yn disposed in the panel 50, a driving voltage generator 58 for applying a driving voltage to the driving units 52, 54, and a timing controller 56 for applying control signals SCS1, SCS2 to the driving units 52, 54. At this time, sustain electrodes Z1 to Zn (omitted) disposed in the panel 50 are connected to a ground voltage GND.

The driving voltage generator 58 generates a variety of driving voltages, and supplies the generated voltages to the address driving unit 52 and the scan driving unit 54 so that a predetermined driving waveform can be generated.

The timing controller 56 generates various switching control signals, and applies them to the address driving unit 52 and the scan driving unit 54 so that a predetermined driving waveform can be generated. For example, the timing controller 56 generates a first switching control signal SCS1, and applies it to the scan driving unit 54. It also generates a second switching control signal SCS2 and a data clock DCLK, and applies them to the address driving unit 52.

The address driving unit 52 supplies image data, which are supplied from the outside, to the address electrodes X1 to Xm according to the data clock DCLK and the second switching control signal SCS2, both of which are supplied from the timing controller 56.

The scan driving unit 54 applies a reset pulse, a scan pulse, and sustain pulses of the negative polarity and the positive polarity to the scan electrodes Y1 to Ym, according to the first switching control signal SCS1 that is supplied from the timing controller 56. At this time, the scan driving unit 5 supplies the sustain pulses, which switch from the negative polarity and the positive polarity, and vice versa, to the scan electrodes Y1 to Ym in order to generate a sustain discharge together with the sustain electrodes Z1 to Zn to which the ground voltage GND is always applied.

Figure 6:
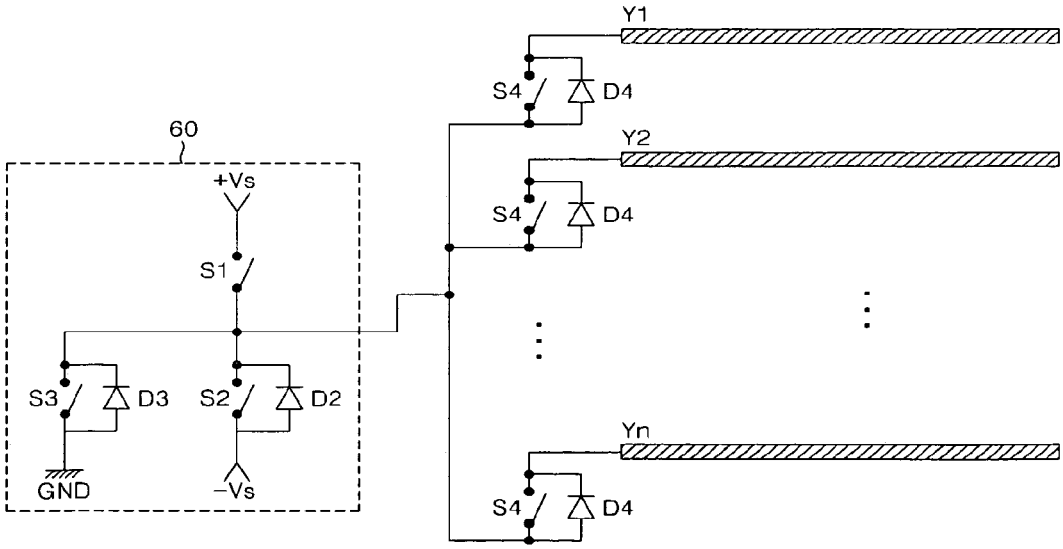
FIG. 6 is a detailed circuit diagram of the scan driving unit shown in FIG. 5.

FIG. 6 is a detailed circuit diagram of the scan driving unit shown in FIG. 5.

Referring to FIG. 6, the scan driving unit 54 includes a driving voltage supply unit 60, and fourth switches S4 connected to the scan electrodes Y1 to Ym, respectively. The fourth switches S4 are disposed between the driving voltage supply unit 60 and the scan electrodes Y, and supply the driving voltage received from the driving voltage supply unit 60 to the scan electrodes Y. At this time, the fourth switches S4 are connected in the open drain manner.

In this case, the switches according to the present invention can be implemented using MOS TR, FET, IGBT, SCR, and the like. If the fourth switches S4 are connected in the open drain manner, leakage current between the scan electrodes Y1 to Yn, etc. can be prevented from occurring. Since the fourth switches S4 are also disposed in the scan electrodes Y one by one, the number of components mounted in the scan driving unit 54 can be minimized. Further, fourth diodes D4, which are respectively connected to the fourth switches S4 in a parallel manner, are further disposed between the driving voltage supply unit 60 and the scan electrodes Y (where, the fourth diodes D4 can be diodes within the fourth switches S4 or external diodes additionally disposed). The fourth diodes D4 serve to supply the driving voltage, which is supplied from the driving voltage supply unit 60, to the scan electrodes Y, and also to prevent the driving voltage from the scan electrodes Y from being supplied to the driving voltage supply unit 60.

The driving voltage supply unit 60 includes a first switch S1 connected between a sustain voltage source +Vs of the positive polarity and the fourth switches S4, a second switch S2 connected between a sustain voltage source −Vs of the negative polarity and the fourth switches S4, and a third switch S3 connected between a ground voltage GND and the fourth switches S4. The first to third switches S1 to S3 are turned on and off under the control of the timing controller 56.

Figure 7:
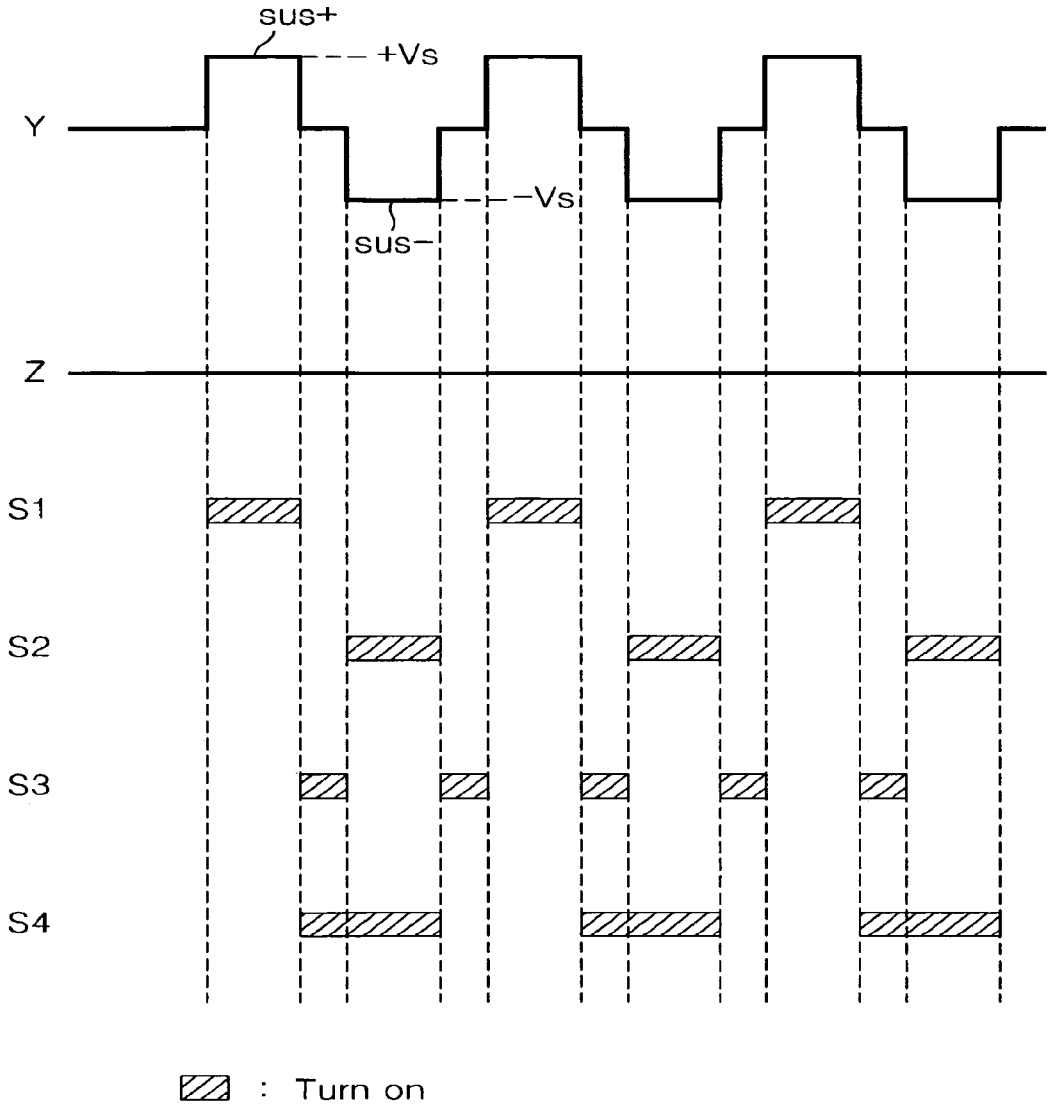
FIG. 7 shows sustain pulses supplied to scan electrodes corresponding to the timing diagram of the switches shown in FIG. 6.

FIG. 7 shows sustain pulses supplied to the scan electrodes corresponding to the timing diagram of the switches shown in FIG. 6.

The process where the sustain pulses are supplied from the scan driving unit 54 will now be described in detail with reference to FIG. 7. As shown in FIG. 7, according to the present invention, during a sustain period, the sustain electrodes Z are kept to the ground voltage GND, and the scan electrodes Y are alternately supplied with the sustain pulse sus+ of the positive polarity and the sustain pulse sus− of the negative polarity (actually, the ground voltage GND is provided between the voltage +Vs, −Vs of the positive polarity and the negative polarity for a predetermined time). Then, as a wall voltage within cells that are selected in a previous address period, and voltage values of the sustain pulse sus+ or sus− of the positive polarity or the negative polarity are added, a sustain discharge is generated in the form of surface discharge between the scan electrodes Y and the sustain electrodes Z whenever the sustain pulses sus+, sus− are applied.

This will be described in more detail. When the sustain pulse sus+ of the positive polarity is applied, the first switch S1 is turned on. If the first switch S1 is turned on, a voltage of the sustain voltage source +Vs of the positive polarity is supplied to the scan electrodes Y1 to Yn through the first switch S1 and the fourth diodes D4. At this time, the scan electrodes Y1 to Yn are supplied with the sustain pulse sus+ of the positive polarity.

After the sustain pulse sus+ of the positive polarity is supplied to the scan electrodes Y1 to Yn, the third and fourth switches S3, S4 are turned on. If the third switch S3 is turned on, the ground voltage GND is applied to the scan electrodes Y1 to Yn through the third and fourth switches S3, S4.

After the ground voltage GND is applied to the scan electrodes Y1 to Yn, the third switch S3 is turned off and the second switch S2 is turned on. If the second switch S2 is turned on, the voltage of the sustain voltage source −Vs of the negative polarity is applied to the scan electrodes Y1 to Yn through the second and fourth switches S2, S4. At this time, the scan electrodes Y1 to Yn are supplied with the sustain pulse sus− of the negative polarity.

After the scan electrodes Y1 to Yn are supplied with the sustain pulse sus− of the negative polarity, the third switch S3 is turned on, and the second and fourth switches S2, S4 are also turned off. If the third switch S3 is turned on, the ground voltage GND is applied to the scan electrodes Y1 to Yn via the third switch S3 and the fourth diodes D4. Practically, in the present invention, while this process is repeatedly performed, the sustain pulses sus+, sus− of the positive polarity and the negative polarity are alternately supplied to the scan electrodes Y1 to Yn.

On the other hand, in an address period, the second switch S2 keeps turned on. Further, when the second switch S2 keeps turned on, the fourth switches S4 are sequentially turned on to supply the scan pulse scan to the scan electrodes Y. At this time, the address driving unit 52 supplies the data pulse, which is synchronized to the scan pulse scan, to the data lines X1 to Xm.

As described above, in the present invention, the sustain electrodes Z are always (during one sub-field period) supplied with the ground voltage GND. If the ground voltage GND is always supplied to the sustain electrodes Z as such, introduction of external noise, generation of EMI, etc., can be minimized, and the stability of a PDP can be improved accordingly.

Further, in the present invention, the sustain electrodes Z are always connected to the ground voltage GND. Thus, a sustain driving unit as in the prior art can be omitted, and EMI, etc., which is generated due to driving of the sustain driving unit, can be prevented. In addition, in the present invention, since the sustain electrodes Z are directly connected to the ground voltage GND, additional generation of noise can be prevented. Moreover, in the present invention, only one switching means S4 is connected to each of the scan electrodes Y in the off drain mode. Therefore, the number of components can be minimized, the manufacture costs can be reduced, and leakage current between electrodes can thus be prevented.

Meanwhile, in the present invention, the scan driving unit 54 can be constructed in various forms. For example, according to the present invention, the scan driving unit 54 can be constructed, as shown in FIG. 8.

Figure 8:
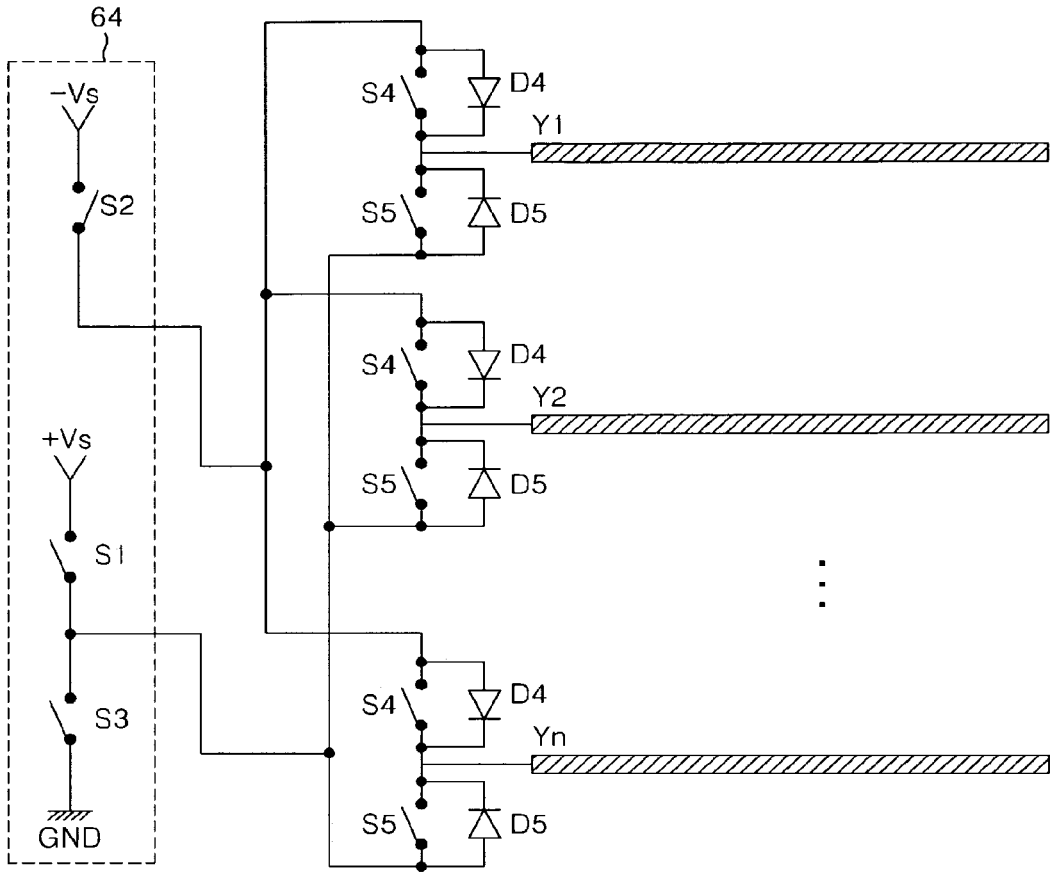
FIG. 8 is another detailed circuit diagram of the scan driving unit shown in FIG. 5.

FIG. 8 is another detailed circuit diagram of the scan driving unit shown in FIG. 5.

Referring to FIG. 8, the scan driving unit 54 according to the present invention includes a driving voltage supply unit 64, and fourth switches S4 and fifth switches S5, which are disposed between scan electrodes Y1 to Ym respectively.

The driving voltage supply unit 64 includes a first switch S1 connected to a sustain voltage source +Vs of the positive polarity, a third switch S3 connected to the ground voltage GND, and a second switch S2 connected to a sustain voltage source −Vs of the negative polarity. The first to third switches S1 to S3 are turned on and off under the control of the timing controller 56.

The fourth switches S4 are connected between the second switch S2 and the scan electrodes Y1 to Ym, respectively, and are turned on and off under the control of the timing controller 56. The fifth switches S5 are connected between a common terminal of the first and third switches S1, S3 and the scan electrodes Y1 to Ym, respectively, and are turned on and off under the control of the timing controller 56. In this case, the fourth switches S4 are connected to the fourth diodes D4 in a parallel manner, and the fifth switches S5 are connected to the fifth diodes D5 in a parallel manner. The fourth and fifth diodes D4 and D5 serve to prevent a driving voltage, which is supplied from the scan electrodes Y1, from being applied to the driving voltage supply unit 64.

The process in which the sustain pulse is supplied from the scan driving unit 54 will now be described in detail with reference to FIG. 9.

Figure 9:
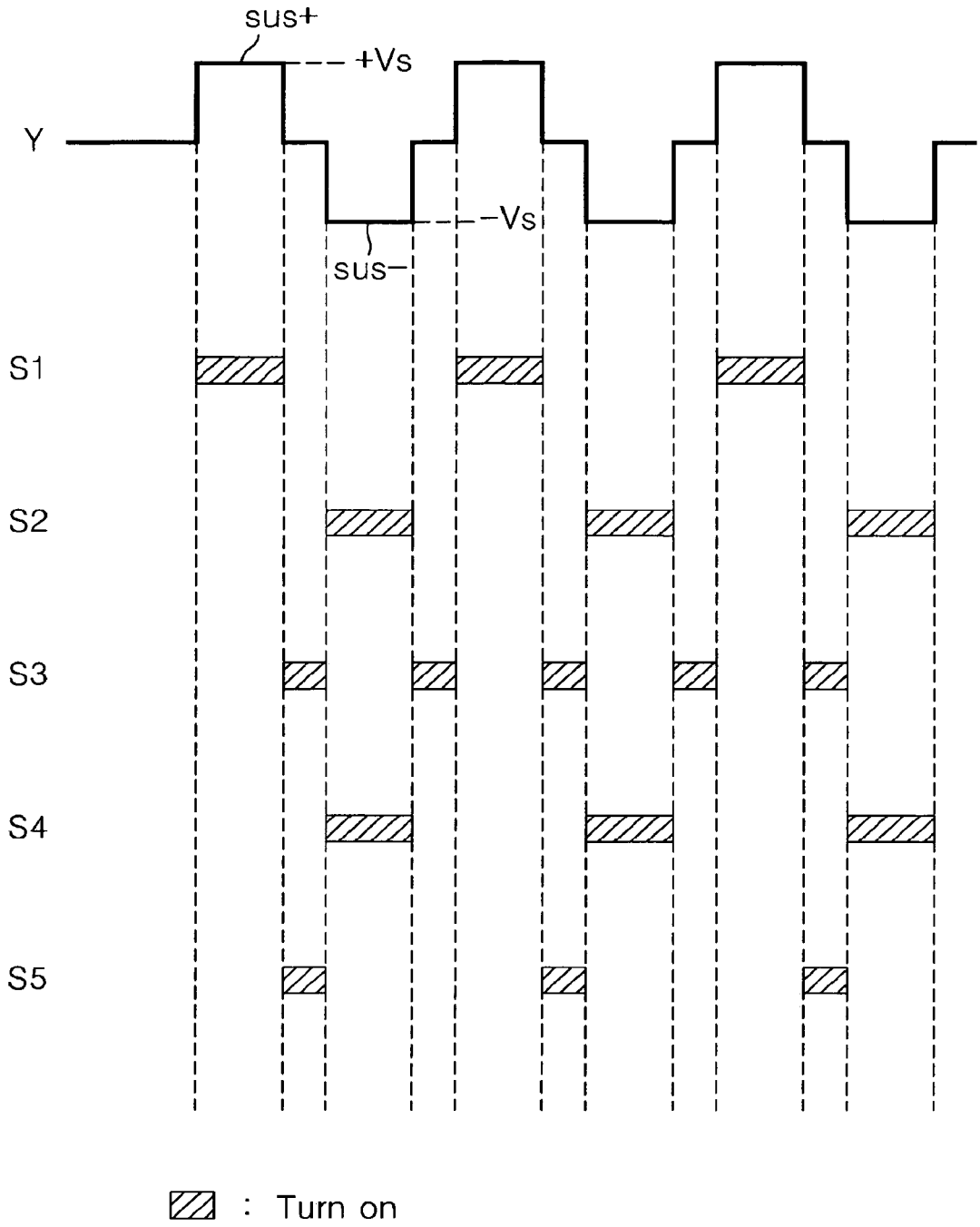
FIG. 9 shows sustain pulses supplied to scan electrodes corresponding to the timing diagram of the switches shown in FIG. 8.

Referring to FIG. 9, the first switch S1 is turned on. If the first switch S1 is turned on, the voltage of the sustain voltage source +Vs of the positive polarity is applied to the scan electrodes Y1 to Yn via the first switch S1 and the fifth diode D5. At this time, the scan electrodes Y1 to Yn are supplied with the sustain pulse sus+ of the positive polarity.

After the scan electrodes Y1 to Yn are supplied with the sustain pulse sus+ of the positive polarity, the first switch S1 is turned off, and the third and fifth switches S3 and S5 are also turned on. If the third and fifth switches S3 and S5 are turned on, the ground voltage GND is applied to the scan electrodes Y1 to Yn through the third and fifth switches S3 and S5.

After the ground voltage GND is applied to the scan electrodes Y1 to Yn, the third and fifth switches S3, S5 are turned off, and the second and fourth switches S2, S4 are also turned on. If the second and fourth switches S2, S4 are turned on, the voltage of the negative polarity of the sustain voltage source −Vs is applied to the scan electrodes Y1 to Yn through the second switch S2 and the fourth switch S4. At this time, the scan electrodes Y1 to Yn are supplied with the sustain pulse sus− of the negative polarity.

After the sustain pulse sus− of the negative polarity is applied to the scan electrodes Y1 to Yn, the second and fourth switches S2, S4 are turned off, and the third switch S3 is also turned on. If the third switch S3 is turned on, the ground voltage GND is applied to the scan electrodes Y1 to Yn through the third switch S3 and the fifth diode D5. Practically, in the present invention, while this process is repeatedly performed, the sustain pulses sus+, sus− of the positive polarity and the negative polarity are alternately applied to the scan electrodes Y1 to Yn.

On the other hand, in an address period, the second switch S2 keeps turned on. Further, when the second switch S2 keeps turned on, the fourth switches S4 are sequentially turned on to sequentially apply scan pulses scan to the scan electrodes Y. At this time, the address driving unit 52 applies the data pulse, which is synchronized to the scan pulse scan, to the data lines X1 to Xm.

As such, in the present invention, the sustain electrodes Z are always (during one sub-field period) supplied with the ground voltage GND. If the ground voltage GND is always applied to the sustain electrodes Z as such, introduction of external noise, generation of EMI, etc. can be minimized, and the stability of a PDP can be improved accordingly.

Furthermore, in the present invention, since the sustain electrodes Z are always connected to the ground voltage GND, a sustain driving unit as in the prior art can be omitted. Generation of EMI, which is generated due to driving of the sustain driving unit, can be also prevented. Moreover, in the present invention, since the sustain electrodes Z are directly connected to the ground voltage GND, additional generation of noise can be prevented.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A plasma display apparatus, comprising:

a plurality of scan electrodes;

a plurality of sustain electrodes formed parallel to the plurality of the scan electrodes; and a scan driving unit for supplying sustain pulses to the plurality of the scan electrodes during a sustain period, wherein the plurality of the sustain electrodes are coupled to a ground voltage during the sustain period, and at a same time the sustain pulses of a first polarity and a second polarity opposite to the first polarity are alternately applied to the plurality of the scan electrodes, wherein the sustain pulses applied to any two adjacent scan electrodes have a same polarity, and wherein the scan driving unit includes:

first switching means for supplying the sustain pulse of the first polarity to the plurality of the scan electrodes;

second switching means for supplying the sustain pulse of the second polarity to the plurality of the scan electrodes; and third switching means for maintaining the plurality of the scan electrodes at the ground voltage.

2. The plasma display apparatus as claimed in claim 1, wherein the scan driving unit further includes fourth switching means for alternately supplying the sustain pulse of the first polarity and the sustain pulse of the second polarity to the scan electrodes.

3. The plasma display apparatus as claimed in claim 1, wherein the sustain pulse of the first polarity and the sustain pulse of the second polarity have an opposite polarity each other.

4. The plasma display apparatus as claimed in claim 3, wherein the sustain pulse of the first polarity has a positive polarity, and the sustain pulse of the second polarity has a negative polarity.

5. The plasma display apparatus as claimed in claim 1, wherein the first switching means is provided between a sustain pulse power source of the first polarity and the plurality of the scan electrodes.

6. The plasma display apparatus as claimed in claim 1, wherein the second switching means is provided between a sustain pulse power source of the second polarity and the plurality of the scan electrodes.

7. The plasma display apparatus as claimed in claim 1, wherein the third switching means is provided between the ground voltage source and the plurality of the scan electrodes.

8. The plasma display apparatus as claimed in claim 1, wherein the scan driving unit alternately selects the first switching means and the third switching means in order to generate the sustain pulse of the first polarity.

9. The plasma display apparatus as claimed in claim 1, wherein the scan driving unit alternately selects the second switching means and the third switching means in order to generate the sustain pulse of the second polarity.

10. A plasma display apparatus, comprising:

a plurality of scan electrodes;

a plurality of sustain electrodes formed parallel to the plurality of the scan electrodes; and a scan driving unit having a negative voltage source for alternately applying sustain pulses having different polarities to the plurality of the scan electrodes during a sustain period, wherein the plurality of the sustain electrodes are coupled to a ground voltage source during the sustain period, wherein the sustain pulses applied to any two adjacent scan electrodes have a same polarity, and wherein the scan driving unit includes:

first switching means for supplying the sustain pulse of a first polarity to the plurality of the scan electrodes;

second switching means for supplying the sustain pulse of a second polarity to the plurality of the scan electrodes; and third switching means for maintaining the plurality of the scan electrodes at a ground voltage.

11. The plasma display apparatus as claimed in claim 10, wherein the scan driving unit further includes fourth switching means and fifth switching means for alternately supplying the sustain pulse of the first polarity and the sustain pulse of the second polarity to the scan electrodes.

12. The plasma display apparatus as claimed in claim 10, wherein the sustain pulse of the first polarity and the sustain pulse of the second polarity have an opposite polarity to each other.

13. The plasma display apparatus as claimed in claim 12, wherein the sustain pulse of the first polarity has a positive polarity, and the sustain pulse of the second polarity has a negative polarity.

14. The plasma display apparatus as claimed in claim 10, wherein the first switching means is provided between a sustain pulse power source of the first polarity and the plurality of the scan electrodes.

15. The plasma display apparatus as claimed in claim 10, wherein the second switching means is provided between a sustain pulse power source of the second polarity and the plurality of the scan electrodes.

16. The plasma display apparatus as claimed in claim 10, wherein the third switching means is provided between the ground voltage source and the plurality of the scan electrodes.

17. The plasma display apparatus as claimed in claim 10, wherein the scan driving unit alternately selects the first switching means and the third switching means in order to generate the sustain pulse of the first polarity.

18. The plasma display apparatus as claimed in claim 10, wherein the scan driving unit alternately selects the second switching means and the third switching means in order to generate the sustain pulse of the second polarity.

19. The plasma display apparatus as claimed in claim 17, wherein the scan driving unit alternately selects the fourth switching means and the fifth switching means in order to generate the sustain pulse of the first polarity.

20. The plasma display apparatus as claimed in claim 18, wherein the scan driving unit alternately selects the fourth switching means and the fifth switching means in order to generate the sustain pulse of the second polarity.

* * * * *